US006021930A

United States Patent [19]

de Pous et al.

[11] Patent Number: 6,021,930

[45] Date of Patent: Feb. 8, 2000

[54] SPRAY PUMP DISPENSER ACCOMMODATING THIN CONFIGURATIONS

[75] Inventors: Olivier de Pous, Paris; Jean-Philippe Lamboux, St. Aubin les Elbeuf, both of France

[73] Assignee: Valois S.A., Le Neubourg, France

[21] Appl. No.: 09/261,730

[22] Filed: Mar. 3, 1999

Related U.S. Application Data

[62] Division of application No. 08/664,142, Jun. 14, 1996.

[51] Int. Cl.[7] ..... B05B 11/06

[52] U.S. Cl. ..... 222/633; 222/209; 222/214; 239/326; 239/362; 239/363

[58] Field of Search ..... 222/631–633, 222/209, 214; 239/326, 362, 363

[56] References Cited

U.S. PATENT DOCUMENTS

| | | |
|---|---|---|
| 334,934 | 1/1886 | Campbell . |
| 728,247 | 5/1903 | Knupke . |
| 1,457,895 | 6/1923 | Campanella . |
| 1,519,199 | 12/1924 | Green . |
| 1,849,616 | 3/1932 | Donegan et al. . |
| 2,091,081 | 8/1937 | Sharpe . |
| 2,134,899 | 11/1938 | Vogel . |
| 2,194,340 | 3/1940 | Vogel . |
| 2,213,846 | 9/1940 | Meyer . |
| 2,239,716 | 4/1941 | Hothersall . |
| 2,276,878 | 3/1942 | Rose . |
| 2,277,530 | 3/1942 | Rose . |
| 2,278,672 | 4/1942 | Rose . |
| 2,310,319 | 2/1943 | Rose . |
| 2,314,263 | 3/1943 | Witt . |
| 2,326,568 | 8/1943 | Rose . |
| 2,332,799 | 10/1943 | Hunn et al. . |
| 2,348,419 | 5/1944 | Rose . |

(List continued on next page.)

FOREIGN PATENT DOCUMENTS

| | | |
|---|---|---|
| 648541 | 2/1928 | France . |
| 675203 | 5/1929 | France . |
| 714675 | 7/1930 | France . |
| 836475 | 1/1939 | France . |
| 993173 | 6/1949 | France . |
| 60237 | 4/1950 | France . |
| 63206 | 4/1951 | France . |
| 986295 | 7/1951 | France . |
| 1098136 | 7/1955 | France . |
| 69735 | 5/1956 | France . |
| 1221876 | 6/1960 | France . |
| 1296172 | 7/1961 | France . |
| 1321558 | 2/1962 | France . |
| 1364163 | 5/1963 | France . |
| 1384046 | 11/1963 | France . |
| 85496 | 3/1964 | France . |
| 260391 | 5/1913 | Germany . |

(List continued on next page.)

OTHER PUBLICATIONS

Sketch A.

European Search Report for European Application No. 97401337.7–2307 which claims priority of the subject application.

*Primary Examiner*—J. Casimer Jacyna

*Attorney, Agent, or Firm*—Rockey, Milnamow & Katz, Ltd.

[57] ABSTRACT

A pump spray dispenser is provided with a squeezable container normally biased to an expanded condition and defining a gas discharge opening. A housing is connected to the container. In one embodiment of the dispenser, a mixing chamber is defined in a housing and communicates with the container. A cartridge holder is defined by the housing for receiving a cartridge that contains a fluid product and that has an openable seal. A fluid product transfer passage establishes communication between the mixing chamber and cartridge when the seal is opened. A spray dispensing orifice is defined in the housing for discharging a spray mixture of the fluid product and gas from the mixing chamber.

4 Claims, 5 Drawing Sheets

U.S. PATENT DOCUMENTS

| | | | |
|---|---|---|---|
| 2,348,420 | 5/1944 | Rose . | |
| 2,349,894 | 5/1944 | Wells . | |
| 2,354,063 | 7/1944 | Rose . | |
| 2,354,064 | 7/1944 | Rose . | |
| 2,359,419 | 10/1944 | Heisenfeldt . | |
| 2,426,281 | 8/1947 | Oakes . | |
| 2,463,002 | 2/1949 | Smith . | |
| 2,621,971 | 12/1952 | Zublin . | |
| 2,918,221 | 12/1959 | Viard . | |
| 3,092,331 | 6/1963 | Kiashek . | |
| 3,785,461 | 1/1974 | Rompa | 239/326 |
| 4,186,783 | 2/1980 | Brandt . | |
| 5,289,952 | 3/1994 | Gueret . | |
| 5,609,189 | 3/1997 | Sternheimer et al. . | |

FOREIGN PATENT DOCUMENTS

| | | |
|---|---|---|
| 1441384 | 11/1968 | Germany . |
| 1425860 | 4/1969 | Germany . |
| 1425881 | 4/1969 | Germany . |
| 42 27 899 A1 | 2/1994 | Germany . |
| 262441 | 6/1949 | Switzerland . |
| 213324 | 3/1924 | United Kingdom . |
| 554723 | 7/1943 | United Kingdom . |
| 1100377 | 1/1968 | United Kingdom . |
| 1155243 | 6/1969 | United Kingdom . |
| 1170549 | 11/1969 | United Kingdom . |
| 1303989 | 1/1973 | United Kingdom . |

SPRAY PUMP DISPENSER ACCOMMODATING THIN CONFIGURATIONS

This is a divisional of U.S. patent application Ser. No. 08/664,142, filed Jun. 14, 1996 and still pending.

TECHNICAL FIELD

This invention relates to a finger-operable pump dispenser that is suitable for embodiment in a relatively thin or flat configuration. The pump dispenser is especially suitable for use as a sample spray dispenser for dispensing small quantities of perfume or the like. The pump dispenser may be readily used in give-away applications or free advertising sample applications wherein the pump dispenser can be delivered as a bound or unbound insert in a magazine or newspaper.

BACKGROUND OF THE INVENTION AND TECHNICAL PROBLEMS POSED BY THE PRIOR ART

Finger-operable dispensing spray pumps are typically adapted to be mounted on hand-held containers. Such containers are commonly used for liquid products, such as household and automotive cleaners, industrial preparations, and personal care products such as hair sprays, deodorants, colognes, and the like. Typically, the pump is operated to produce a fine mist or atomized spray.

Finger-operable pumps conventionally employ a pump chamber in which is disposed a pressurizing piston that can be actuated by pressing down on an external actuator button or plunger. A spring acts against the piston or actuator button to return the piston and actuator button upwardly to the elevated rest position when the finger pressure is released.

Typically, a valve member is provided within the pump and is biased by a spring to close a discharge passage at a valve seat. This permits a predetermined pressure to be built up within the pump chamber as the pump actuator is pressed downwardly. When the pressure force within the pump chamber exceeds the valve member spring biasing force, the valve member opens to permit discharge of the pressurized liquid from the pump chamber.

The discharging liquid exits the pump through a nozzle as a jet stream, a coarse spray, an atomized fine spray, etc., depending upon the structure of the nozzle, operating pressures, stroke speed, and characteristics of the liquid being dispensed.

Typically, finger-operable spray pumps have generally circular cylindrical components which are attached to a generally circular neck of a container. Generally, the size, weight, and complexity of the pump components and container combination discourage the use of such combinations as give-away items to provide product samples for advertising purposes. Accordingly, it would be desirable to provide a finger-operable pump dispenser which could be made relatively inexpensively and in a small enough size for use as a give-away sample system for advertising purposes.

Further, it would be advantageous if such an improved pump dispenser could be provided in a generally flat configuration for being placed between the pages of a newspaper or magazine as an advertising insert.

Further, it would be beneficial if such an improved pump dispenser could accommodate incorporation in a relatively flat configuration for readily accepting printed advertising text and graphics for display in an easy-to-read manner.

It would be desirable if such an improved pump dispenser could also be produced in a size small enough to fit in a pocket or purse and could dispense sprays of perfume or other products, such as medicaments, insect repellant, etc.

Preferably, a pump dispenser incorporating such improved design features should also perform consistently with respect to the discharge particle size and the required actuation force as well as with respect to the quantity of discharged product per full stroke actuation.

Advantageously, such improved design features should also be readily incorporated in the pump dispenser and in components therefor so as to facilitate economical manufacture, high production quality, and consistent operating parameters unit-to-unit with high reliability.

The present invention provides an improved pump dispenser system which can accommodate designs having the above-discussed benefits and features.

SUMMARY OF THE INVENTION

According to the present invention, a manually operable pump dispenser is provided for dispensing a spray. The pump dispenser is especially suitable for spraying perfume. The pump dispenser can be embodied in a relatively thin or flat configuration for use as a sample dispenser inserted in a newspaper or magazine. In one contemplated embodiment, the pump dispenser has a generally rectangular configuration similar to that of a credit card, and the thickness may range from a few millimeters to 1 centimeter. Of course, the pump dispenser can be made considerably thicker if desired.

According to one aspect of the invention, the pump dispenser includes a squeezable container normally biased to an expanded condition and defining a gas discharge opening. A housing is connected to the container and defines a mixing chamber communicating with the container. The housing defines a cartridge holder for receiving a cartridge that contains a fluid product and that has an openable seal. The housing also defines a fluid product transfer passage for establishing communication between the mixing chamber and the cartridge when a seal is opened. A spray dispensing orifice is provided in the housing for discharging a spray mixture of the fluid product and gas from the mixing chamber.

According to another aspect of the invention, the pump spray dispenser includes a squeezable container that is normally biased to an expanded condition, and the container includes a non-return inlet valve for admitting ambient atmospheric air as the container assumes the expanded condition. The container also includes a non-return outlet valve for discharging compressed air. A mixing chamber contains an air-pervious fill material impregnated with a fluid product. The chamber defines a dispensing orifice and has a removable closure for sealing the orifice. The chamber also defines an inlet opening communicating with the container outlet valve whereby, upon removal of the closure, the container can be squeezed to direct compressed air into the chamber for mixing with the product and to spray a mixture of the product and air from the orifice.

According to another aspect of the invention, the pump includes a squeezable container with valves as described above, and further includes a housing defining a receiving cavity communicating with the container outlet valve and defining a dispensing orifice communicating with the receiving cavity. A cartridge is rotatably mounted in the receiving cavity and defines a mixing chamber containing an air-pervious fill material impregnated with a fluid product. The cartridge defines an outlet aperture and an inlet aperture which are in communication with the dispensing orifice and outlet valve, respectively, when the cartridge is in a selected rotational position. The container can be squeezed to direct the compressed air into the mixing chamber for mixing with the product and to dispense a spray mixture of the product and air through the outlet aperture and dispensing orifice. When the cartridge is rotated away from the selected rotational position, flow through at least the dispensing orifice is blocked.

According to yet another aspect of the invention, a pump spray dispenser is provided with a squeezable container having a non-return inlet valve and a non-return outlet valve as described above. The dispenser also includes a mixing chamber defining a dispensing orifice, and the chamber defines an inlet opening communicating with the outlet valve. A product storage chamber is provided in the pump, and a passage communicates between the storage chamber and the mixing chamber. A wick extends from the storage chamber through the passage into the mixing chamber. The wick prevents bulk liquid flow of the product out of the storage chamber through the passage, but permits wicking of the product along the wick from the storage chamber into the mixing chamber. When the container is squeezed, compressed air is directed into the mixing chamber and mixes with the product therein to dispense a spray mixture of the product and the air from the dispensing orifice.

Another aspect of the invention includes a pump dispenser having a squeezable container normally biased to an expanded condition. The container includes an air discharge opening and includes a non-return inlet valve which opens to admit air into the container when the container expands. The non-return inlet valve closes when the container is squeezed. A housing is connected to the container and defines a mixing chamber. The housing also defines a cartridge holder for receiving a cartridge that contains a fluid product that has a seal which is openable upon application of force against the seal. A cartridge seal contact member is provided for engaging and opening the cartridge seal upon movement of the cartridge toward the contact member. The housing also includes a fluid product transfer passage for establishing communication between the mixing chamber and the cartridge when the seal is opened. A compressed air delivery passageway communicates between the mixing chamber and the container discharge opening. A spray dispensing orifice is provided in the housing for discharging a spray mixture of the fluid product and air from the mixing chamber.

According to yet another aspect of the invention, a pump spray dispenser includes a housing for a cartridge in communication with a pump. The cartridge contains a fluid product and has a seal that is openable upon the application of force against the seal. The pump has a compression chamber defined within a collapsible container that includes a pair of substantially rigid, opposed wall portions which are normally biased to an expanded condition and which may be squeezed closer together to collapse the container. The container includes a discharge opening for discharging compressed air from the compression chamber. The container includes a normally closed, non-return inlet valve which opens to admit air into the container when the container wall portions move toward the expanded condition and which closes when the container wall portions are squeezed. The housing defines a mixing chamber. The housing also includes a cartridge seal contact member and a cartridge holder for receiving the cartridge with the seal adjacent the contact member to accommodate inward movement of the cartridge toward the contact member to force the seal against the contact member to open the seal. A fluid product transfer passage between the mixing chamber and the cartridge holder is defined in the housing for communicating with the cartridge when the seal is opened. This directs the fluid into the mixing chamber. The housing also defines a compressed air delivery passageway extending between the mixing chamber and the container discharge opening for directing compressed air into the mixing chamber. The housing also has a spray dispensing orifice communicating between the mixing chamber and the exterior of the housing for discharging a spray mixture of the fluid product and air.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

FIG. 9 shows one of the cartridges in a moved position;

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the embodiments of the dispenser of this invention are described in particular positions, and terms such as upper, lower, horizontal, etc., are used with reference to these positions. It will be understood, however, that embodiments of the dispenser of this invention may be manufactured, stored, transported, used, and sold in orientations other than the positions described.

Figures illustrating the dispenser show some mechanical elements that are known and that will be recognized by one skilled in the art. The detailed descriptions of such elements are not necessary to an understanding of the invention, and accordingly, are herein presented only to the degree necessary to facilitate an understanding of the novel features of the present invention.

Figure 1:
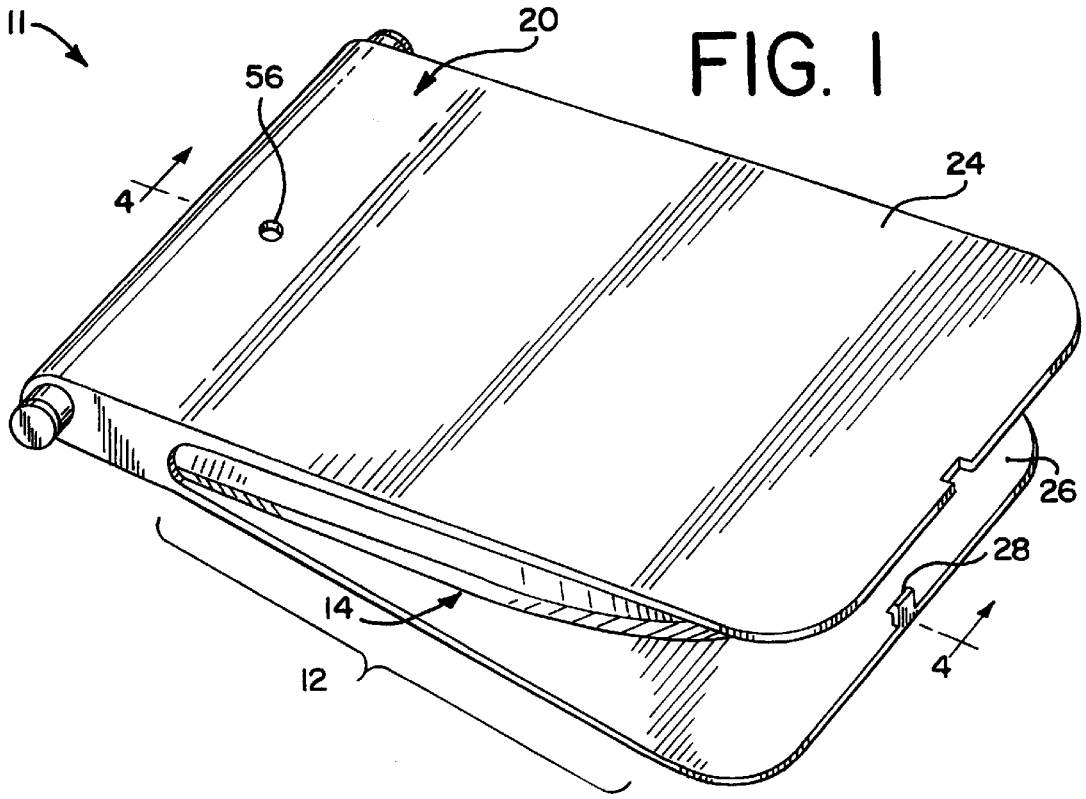
FIG. 1 is a perspective view of a first embodiment of the spray pump dispenser of the present invention.
Figure 2:
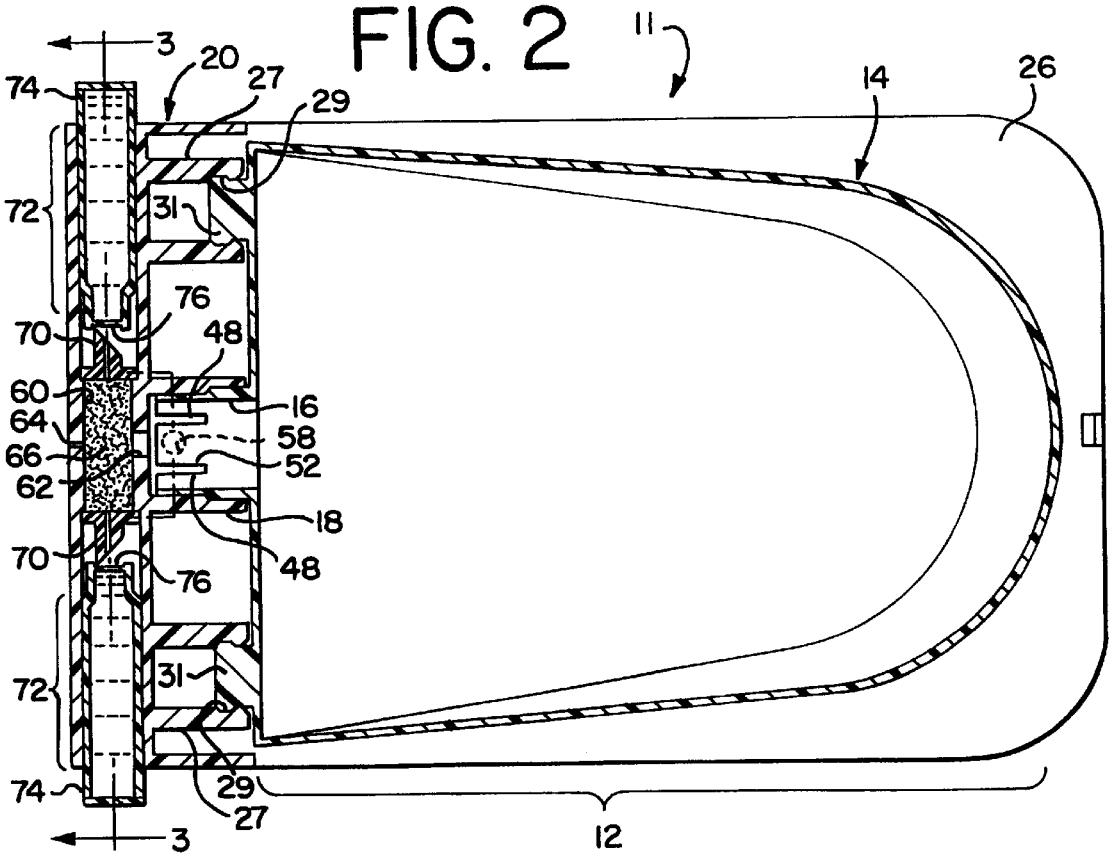
FIG. 2 is a cross-sectional plan view of the dispenser illustrated in FIG. 1.
Figure 3:
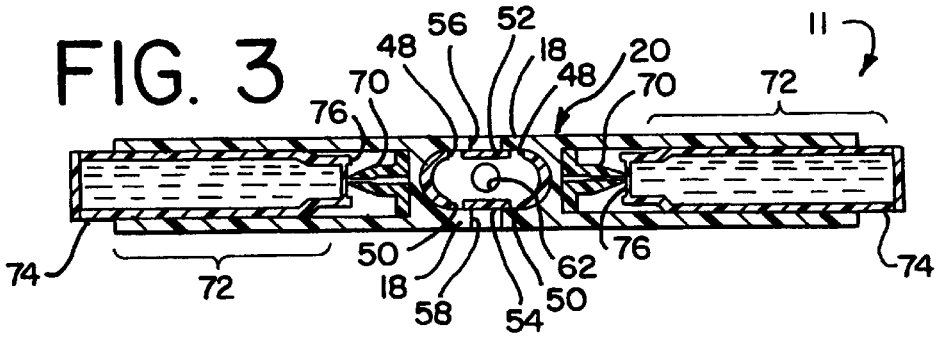
FIG. 3 is a cross-sectional view taken generally along the two view planes 3—3 in FIG. 2.

FIGS. 1–5 and 9 illustrate a first embodiment of the dispenser in accordance with the teachings of the invention. The dispenser is designated generally in FIGS. 1–5 and 9 by the reference number 11. The dispenser 11 includes a squeezable container 12 (FIG. 2) which is normally biased to an expanded condition as shown in FIG. 1. The container 12 includes a flexible bag 14 having a tubular end portion 16 (FIG. 2).

In the preferred embodiment illustrated in FIGS. 1–5 and 9, the container 12 also includes a rigid sleeve 18 (FIG. 2) which surrounds the flexible bag tubular end portion 16. The rigid sleeve 18, in the preferred embodiment illustrated, extends from a housing 20. Preferably, the housing 20 and sleeve 18 are molded as a unitary structure which also includes a pair of opposed, plate-like members or wall portions—upper plate-like member 24 and lower plate-like member 26. In a presently contemplated preferred embodiment, the plate-like members 24 and 26 can be molded along with the housing 20 from a polyacetal material. Preferably, the upper and lower surfaces of the flexible bag 14 are secured to the inwardly facing surfaces of the plate-like members 24 and 26. The members 24 and 26 can be regarded as defining an outer part of the container 12.

The bag 14 may be formed from rubber, polyethylene, or other suitable material. Depending upon the materials used for the members 24 and 26 and the bag 14, the members 24 and 26 may be attached to the sidewalls of a bag 14 by means of a heat-seal weld, adhesive, or mechanical attachments.

The front end of the bag 14 is preferably also secured to the housing 20. As illustrated in FIG. 2, the housing 20 has a pair of annular holding collars 27 each defining an annular groove 29. The bag 14 has a pair of retention knobs 31 which each has an enlarged head portion for being received in a snap-fit engagement within the groove 29 of one of the holding collars 27.

Figure 4:
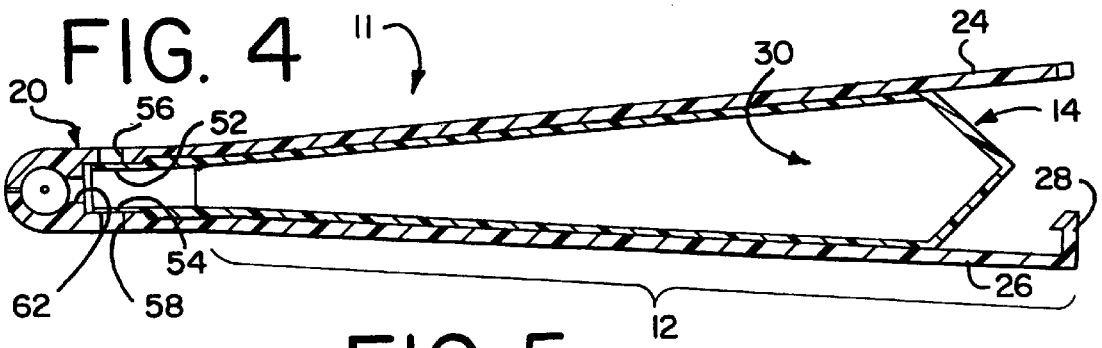
FIG. 4 is an enlarged, cross-sectional view taken generally along the plane 4—4 in FIG. 1.

The plate-like members 24 and 26 are preferably molded from a generally rigid, thermoplastic material as a unitary structure with the housing 20. Although the plate-like members 24 and 26 are preferably cantilevered from one end at the housing 20, the members 24 and 26 are characterized as defining, in the embodiment illustrated in FIGS. 1–5 and 9, an exterior part of the container 12. The members 24 and 26 have sufficient stiffness so that they are normally biased outwardly to maintain the container 12 (which includes the members 24 and 26 and bag 14) in an expanded condition as shown in FIGS. 1 and 4. However, the plate-like members 24 and 26 are sufficiently resilient—typically at the regions adjacent the housing 20—so as to accommodate inward deflection to a closed position illustrated in FIG. 5.

Figure 5:
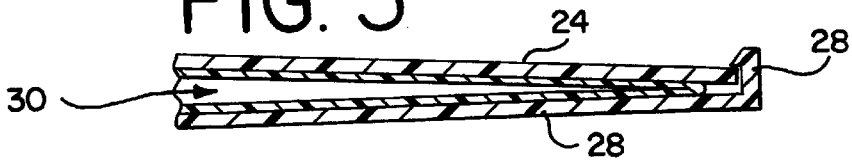
FIG. 5 is a fragmentary, cross-sectional view similar to FIG. 4, but FIG. 5 shows the dispenser components moved to a latched closed configuration.

The container 12 may be manually squeezed to the closed condition illustrated in FIG. 5 and then maintained in that position by means of a latch 28 projecting upwardly from the lower plate-like member 26 (FIG. 5). The interior of the container, and particular the interior of the flexible bag 14, defines a compression chamber 30 (FIG. 4). When the plate-like members 24 and 26 are squeezed together (as shown in FIG. 5), the pressure within the chamber 30 is increased.

Figure 6:
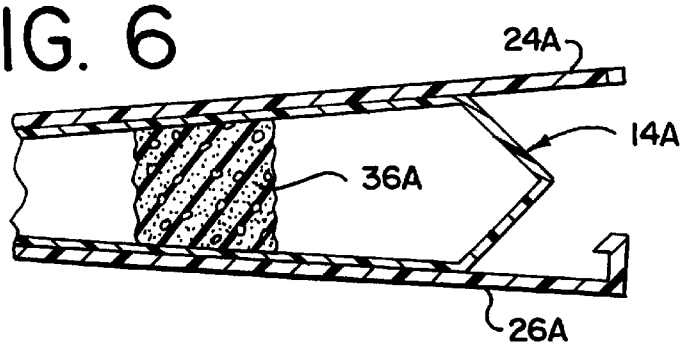
FIG. 6 is a view similar to FIG. 5, but FIG. 6 illustrates a second embodiment of the dispenser.

The plate-like members 24 and 26 need not be molded as a unitary part of the structure along with the housing 20. The members 24 and 26 could be separate pieces adapted to pivot about their ends adjacent the housing 20. In such a case, means for urging the members 24 and 26 apart to the expanded condition could be provided in the form of an internal spring mechanism. For example, FIG. 6 illustrates a second embodiment of the dispenser which employs a post of resilient material 36A inside a flexible bag 14A between two plates 24A and 26A. The post material 36A may be a thermoplastic foam. A metal spring could also be employed. Such an internal spring system may also be employed, if desired, inside the bag 14 of the first embodiment of the dispenser 11 illustrated in FIGS. 1–5, and such a spring system would provide an additional biasing force to urge the container 12 to the expanded condition.

It will also be appreciated that such an internal spring system may be incorporated in a dispenser wherein the opposed sidewalls of the flexible bag 14 are not attached to the inner surfaces of the plate-like members 24 and 26. If the members 24 and 26 are not attached to the sides of the bag 14, then movement of the members 24 and 26 to the spaced-apart, expanded condition will not pull the walls of the bag 14 outwardly to the expanded condition. In such a spring system, a spring in the bag interior would urge the bag walls to spread apart to the expanded condition.

Figure 7:
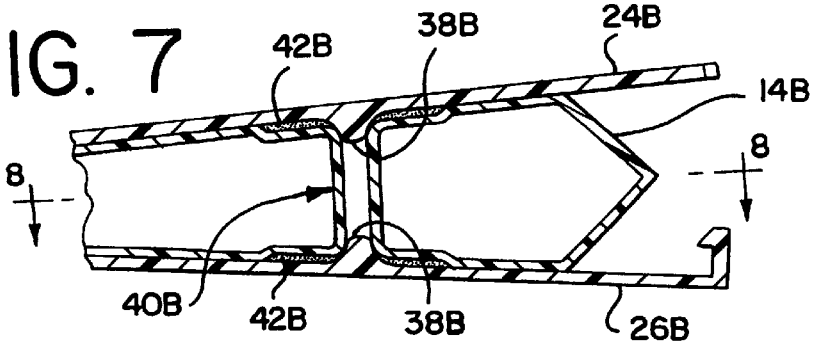
FIG. 7 is a view similar to FIG. 6, but FIG. 7 illustrates a third embodiment of the dispenser.
Figure 8:
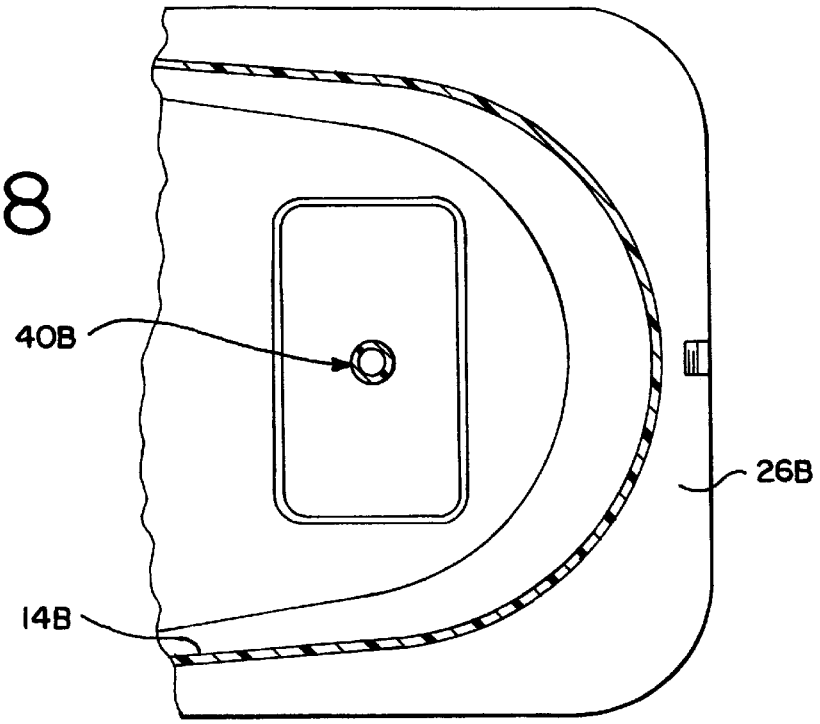
FIG. 8 is a fragmentary view taken generally along the plane 8—8 in FIG. 7.
Figure 9:
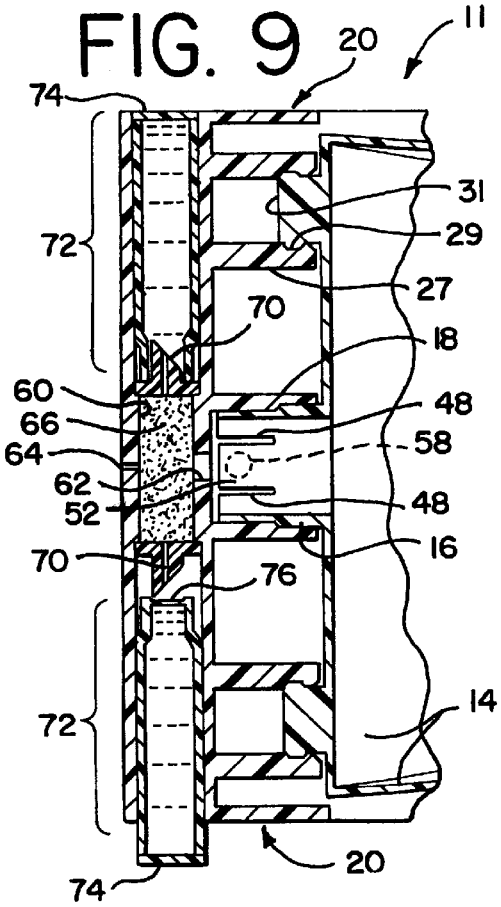
FIG. 9 is an enlarged, fragmentary, cross-sectional view of the first embodiment shown in FIGS. 1–5.

Another embodiment of an internal spring system is illustrated in FIGS. 7 and 8. In the embodiment illustrated in FIGS. 7 and 8, a flexible bag 14B is disposed two plates 24B and 26B. Each plate 24B and 26B has an inwardly projecting, convex protuberance 38B. The bag 14B includes a hole for accommodating the protuberances 38B, and the hole is defined by a tube-like structure 40B of the bag 14B. Adhesive 42B may be provided around each protuberance 38B for securing an adjacent portion of the bag 14B to the plate. If the material from which the bag 14B is fabricated is sufficiently thick and/or resilient, the tube 40B can function as a spring for biasing the bag 14B to the expanded condition illustrated in FIG. 7.

Returning now to the bag 14 of the first embodiment illustrated in FIGS. 1–5 and 9, and with particular reference to tubular open end portion 16 (FIGS. 2 and 3), the portion 16 defines a pair of parallel, upper slots 48 and a pair of lower slots 50. The upper slots 48 define between them a flap 52, and the lower slots 50 define between them a flap 54. The upper flap 52 is normally maintained by the inherent resiliency of the bag material against a vent aperture 56 defined in the upper wall of the housing 20. The lower flap 54 is normally maintained by the inherent resiliency of the bag material against a lower vent aperture 58 defined by the housing 20. The flaps 52 and 54 overlap peripheral portions of the housing adjacent the vent apertures 56 and 58, respectively, so as to normally occlude the apertures in an air-tight manner when the pressure within the bag 14 is increased above atmospheric pressure by squeezing the plate-like members 24 and 26 together.

When the members 24 and 26 are squeezed together, the increased internal pressure in the bag 14 causes the air contained therein to flow through the tubular open end portion 16 and out into the passages and cavities defined within the housing 20 described in detail hereinafter.

However, when the squeezed members 24 and 26 are released and permitted to return to the expanded condition (shown in FIGS. 1 and 4), the reduction in internal pressure within the bag 14 creates a pressure differential across the flaps 52 and 54 owing to the higher ambient air pressure on the exterior of the dispenser 11. This forces the flaps 52 and 54 to deflect inwardly and permit the passage of air into the bag 14.

The housing 20 defines a mixing chamber 60 (FIG. 2) and a compressed air delivery passageway 62 communicating between the mixing chamber 60 and the container discharge opening defined by the bag tubular open end portion 16. A spray dispensing orifice 64 is defined at the front of the housing 20 and establishes communication between the interior of the mixing chamber 60 and the exterior of the housing 20.

In the preferred embodiment illustrated in FIGS. 1–5 and 9, a filling of fibrous material 66 (FIG. 2) is provided in the mixing chamber 60. The fibrous material can be polypropylene fibers. If desired, a small screen (not shown) may be provided across the compressed air delivery passageway 62 to prevent the fibers 66 from bulging into the passageway 62 and perhaps falling into the bag 14.

Opposite ends of the mixing chamber 60 are defined by contact members 70. Each contact member 70 includes a hollow piercing tube projecting outwardly away from the mixing chamber 60.

Adjacent each piercing tube contact member 70 is a cartridge cavity or cartridge holder 72 (FIGS. 2 and 3) for receiving a cartridge 74. Each cartridge 74 contains a fluid product (e.g., a liquid perfume or a pharmaceutical medicament) and has a seal 76. In the preferred embodiment illustrated, each seal 76 is a pierceable membrane.

Each cartridge 74 is frictionally engaged with the inside surface of the adjacent cartridge holder 72 so as to initially maintain the cartridges 72 in the positions shown in FIG. 2 wherein each cartridge seal 76 is adjacent the tip of the hollow piercing tube contact member 70. If desired, each cartridge 74 may be provided with an annular bead or groove (not shown), and each holder 72 may be provided with a mating groove or bead (not shown), respectively, for initially holding the cartridges 74 in a snap-fit engagement.

Because the cartridges 74 are initially sealed, the liquid or gas product within the cartridges 74 cannot leak or dissipate prior to use. When it is desired to operate the dispenser 11, one or both of the cartridges 74 are pushed inwardly against the adjacent seal contact member piercing tube 70. This causes the cartridge seal 76 to be ruptured or punctured (as shown for one of the cartridges 74 in FIG. 9).

When the seal 76 is punctured, the liquid or gas product can flow from the cartridge 74 into the mixing chamber 60. Leak tightness is insured owing to a sealing frictional engagement between the exterior of the contact member piercing tube 70 and the interior edge of the pierced cartridge 74 and/or owing to a sealing engagement between the exterior of the cartridge 74 and the interior surface of the cartridge receiving cavity or holder 72.

The liquid or gas product flows through the punctured seal from the cartridge 74 into the mixing chamber 60 and into the fibrous material 66. Capillary action will draw a liquid product into the fibrous material 66 in the chamber 60. The fibrous material 66 becomes impregnated with the product. This prevents the accumulation of bulk liquid within the chamber 60 which might otherwise tend to leak out of the dispensing orifice 64 or into the interior of the bag 14. As used herein and in the claims, the term "impregnated" refers generally to the retention of the fluid product on or in the fibrous material by means of absorption, adsorption, coating, capillary action, or the like.

After the fibrous material 66 is impregnated with the product that had been stored in one or both of the cartridges 74, the dispenser 11 may be operated to spray the product. To this end, if the plate-like members 24 and 26 are still in the initially latched, closed position (FIG. 5), then the latch 28 is opened to permit the members 24 and 26 to spring apart to the expanded condition (FIG. 4). This draws air into the chamber 30 of the bag 14 (because ambient air enters through the vent inlet apertures 56 and 58 as previously described).

The members 24 and 26 can then be squeezed together to compress the air within the chamber 30. This forces the air through the compressed air delivery passageway 62 and into the mixing chamber 60. The compressed air mixes with the product which is impregnated in (contained or trapped within or on) the fibrous material 66. The compressed air mixes with the product, and the mixture is forced out of the dispensing orifice 64 as a spray.

The embodiment of the dispenser 11 illustrated in FIGS. 1–5 and 9 can have a relatively thin and flat configuration when closed (FIG. 5). Thus, the dispenser 11 may be inserted into a newspaper or magazine as a give-away sample.

The dispenser 11 can be fabricated from plastic or metallic materials which will withstand compressive loads (e.g., 800 $kg/m^2$ or more). This is sufficient to withstand the weight of a typical stack of newspapers or magazines as such newspapers and magazines are commercially manufactured, shipped, or stored.

Advertising can be printed on the exterior surfaces of the dispenser 11 and/or on advertising sheets packed with the dispenser 11 in the newspaper or magazine. The dispenser 11 may also be secured with a releasable adhesive on one side to a paper sheet, and the sheet may then be bound within the magazine or folded loosely within the newspaper.

Because the product is sealed within the cartridges 74, the dispenser 11 has a long shelf life. Further, after the dispenser is operated and all of the fluid product is dispensed, new, full, sealed cartridges 74 could be provided to the user to permit reuse of the dispenser 11. This would be especially suitable for dispensing pharmaceutical preparations or medicaments, including those requiring a physician's prescription.

Because the dispenser 11 and cartridges 74 can be provided in a relatively small assembly (e.g., having a length and width about equal to the length and width of a standard credit card and having a thickness less than 10 mm), the capacity can be limited to relatively small doses. A small capacity limitation may be desirable with certain pharmaceutical preparations. Such a dispenser may be readily used for dispensing only a single dose or small numbers of doses. The dispenser 11 may be easily carried in a pocket or purse.

In addition, the dispenser 11 with the sealed cartridges 74 will not leak when subjected to reduced ambient atmospheric pressure, such as in an airplane—either in an unpressurized cargo bay or in a passenger cabin pressurized to less than one atmosphere.

Figure 10:
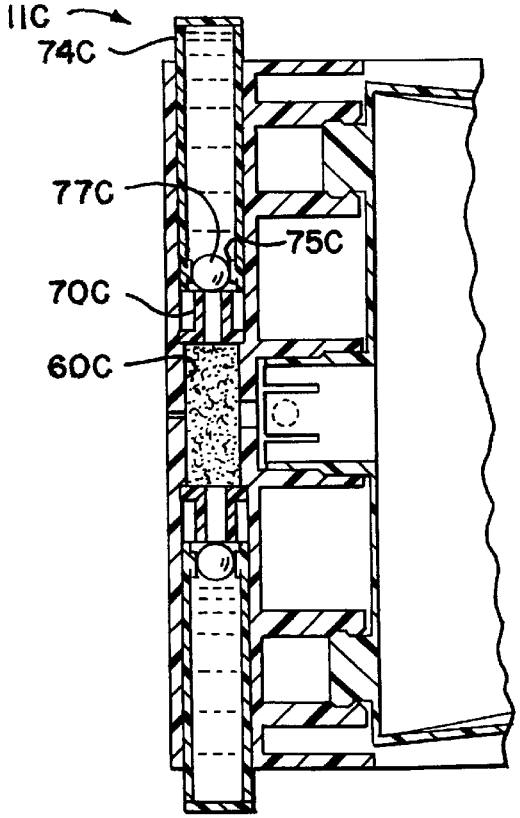
FIG. 10 is a view similar to FIG. 9, but FIG. 10 shows a fourth embodiment of the dispenser.

FIG. 10 illustrates a fourth embodiment of the dispenser designated generally by the reference number 11C. The dispenser 11C has substantially the same construction as the first embodiment of the dispenser 11 described above with reference to FIGS. 1–5 and 9. However, the fourth embodiment dispenser 11C employs a different cartridge 74C and a different cartridge contact member 70C.

In particular, the cartridge 74C does not have a membrane seal like the seal 76 employed in the first embodiment of the dispenser 11. Rather, the cartridge 74C includes an opening defined by an annular seal 75C which is initially sealingly occluded by a ball 77C. The seal contact member 70C has a tubular configuration for engaging the ball 77C. When the cartridge 74C is subsequently pushed inwardly, the ball 77C is dislodged from its sealing engagement with the annular seal 75C, and the fluid product within the cartridge 74C can flow through the tubular contact member 70C into the mixing chamber 60C. The operation of the dispenser 11C is otherwise identical with the operation described above for the first embodiment of the dispenser 11 illustrated in FIGS. 1–5 and 9.

Figure 11:
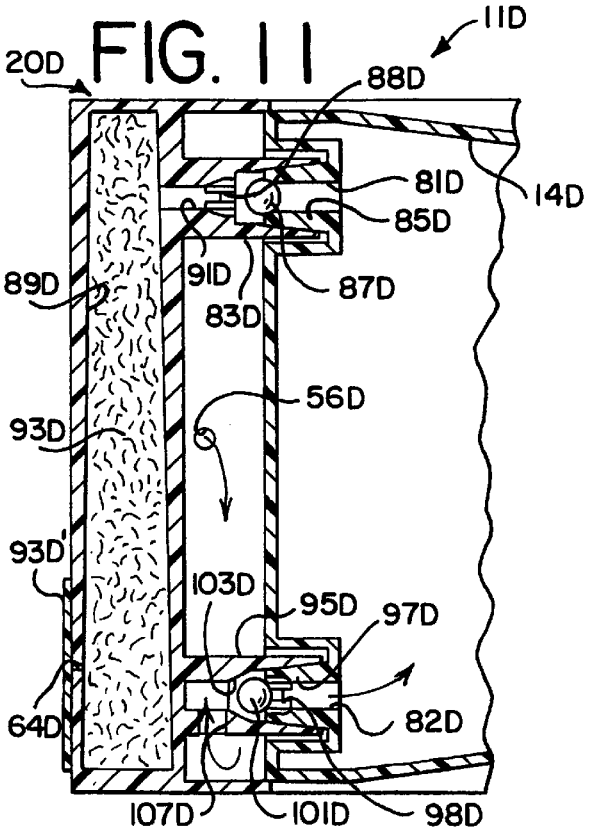
FIG. 11 is a view similar to FIG. 10, but FIG. 11 illustrates a fifth embodiment of the dispenser.

FIG. 11 illustrates a fifth embodiment of the dispenser 1D. The dispenser 11D has a container which includes a flexible bag 14D. The bag 14D is attached to a housing 20D and has two openings 81D and 82D. The opening 81D is a compressed gas outlet opening, and the opening 82D is an ambient air inlet vent opening.

Extending from the housing 20D is a non-return outlet valve body 83D. The outlet valve body 83D receives an annular neck 85D of the flexible bag 14D which defines the outlet opening 81D. The distal end of the outlet neck 85D functions as a seat which is sealingly occluded by a ball 87D when the pressure within the flexible bag 14D is less than the exterior ambient air pressure. When the pressure within the flexible bag 14D is increased, the ball 87D is forced outwardly (to the left as viewed in FIG. 11) against a portion of the outlet valve body 83D which defines flow passages 88D to accommodate flow of the air from the bag 14D past the ball 87D.

The valve body 83D, the ball 87D, and the annular seat defined by the bag outlet neck 85D together may be characterized as defining a non-return outlet valve which (1) opens to pass compressed air out of the bag when the bag is squeezed, and (2) closes when the bag is permitted to expand.

The housing 20D defines a mixing chamber 89D and an inlet passage or opening 91D establishing communication between the chamber 89D and the outlet valve body 83D. The mixing chamber 89D includes an air-pervious, fibrous material 93D which is impregnated with fluid (gas or liquid) product.

The housing 20D and chamber 89D define a dispensing orifice 64D established between the interior of the chamber 89D and the exterior of the dispenser 11D. The dispenser 11D is initially provided to the user with a removable, exterior seal 93D occluding the dispensing orifice 64D. The seal 93D can be an adhesively secured tab or tape.

Extending from the housing 20D to the bag 14D is another projection which defines a non-return inlet valve body 95D. The body 95D is sealingly engaged with an inlet neck 97D defined by the bag 14D around the inlet vent opening 82D. The valve body 95D includes an inlet aperture 107D which communicates with an inlet vent aperture 56D defined in a rigid wall extending forwardly of the flexible bag 14D.

A ball 101D is disposed within the valve body 95D. The valve body 95D defines a seat 103D against which the ball 101D is sealingly engaged when the pressure within the flexible bag 14D increases. When the pressure within the bag 14D decreases below the ambient atmospheric pressure, the valve ball 101D is forced off of the seat 103D (to the position shown in FIG. 11). The flexible bag neck 97D is provided with suitable channels or slots 98D to accommodate flow of ambient atmospheric air past the ball 101D into the bag 14D. The aperture 56D, valve body 95D, and ball 101D may be characterized as a non-return inlet valve which (1) opens to admit air into the container flexible bag 14D when the bag expands, and (2) closes when the bag is squeezed.

When it is desired to operate the dispenser 11D, the tab 93D, is removed to open the dispensing orifice 64D. If the bag 14D is not expanded, then the bag 14D is permitted to expand (e.g., by releasing exterior squeezing or clamping forces). If the bag is contained within plates, such as plates 24 and 26 described above with reference to the first embodiment illustrated in FIGS. 1–5 and 9, then the latch 28 would be initially released.

As the bag 14D fills with air through the inlet vent valve system (e.g., which includes the ball 101D), the bag expands to the expanded condition. Subsequently, the bag 14D is squeezed to force air through the outlet valve (e.g., which includes the ball 87D) into the mixing chamber 89D. The air mixes with the product within the chamber 89D, and the mixture is dispensed through the orifice 64D as a spray.

Figure 12:
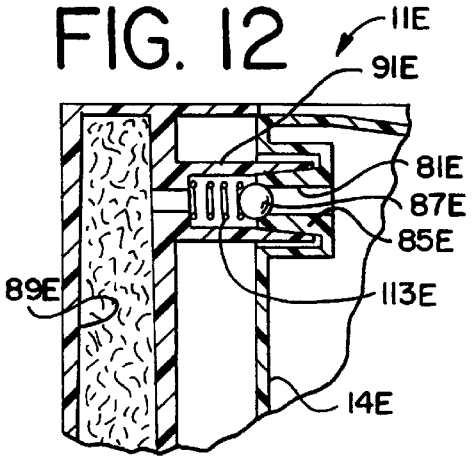
FIG. 12 is a view similar to FIG. 11, but FIG. 12 illustrates a sixth embodiment of the dispenser.

FIG. 12 illustrates a sixth embodiment of the dispenser of the present invention wherein the dispenser is characterized generally by the reference number 11E. The dispenser 11E is substantially the same as the same fifth embodiment of the dispenser 11D described above with reference to FIG. 11 except that in the sixth embodiment an outlet valve body 91E has an internal configuration for receiving a helical compression spring 113E to bias a ball 87E against the neck 85E of a container flexible bag 14E so as to normally occlude the bag outlet opening 81E defined by the neck 85E.

When the bag 14E is squeezed, the force of the compression spring 113E is overcome, and the ball 87E moves outwardly to permit the compressed air to be forced through the valve body 91E into a mixing chamber 89E which has the same configuration and function as the mixing chamber 89D in the fifth embodiment of the dispenser 11D discussed above with reference to FIG. 11.

Figure 13:
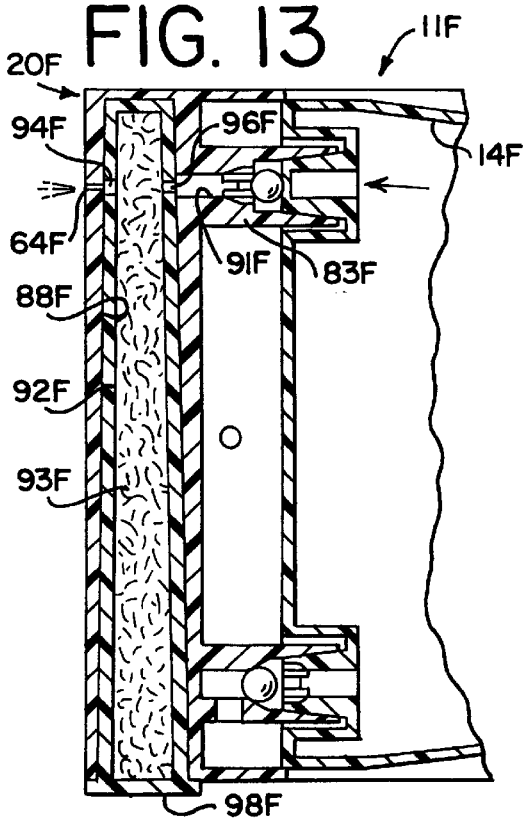
FIG. 13 is a view similar to FIG. 11, but FIG. 13 illustrates an seventh embodiment of the dispenser.

FIG. 13 illustrates a seventh embodiment of a dispenser designated generally by the reference number 11F. The dispenser 11F is substantially similar to the fifth embodiment of the dispenser 11D described above with reference to FIG. 11. However, dispenser 11F differs from the dispenser 11D in that the dispenser 11F has a housing 20F which defines a frustoconical cavity 88F and a dispensing orifice 64F that establishes communication between the cavity 88F and the exterior of the housing 20F.

A frustoconical cartridge 92F is rotatably mounted in the housing cavity 88F. The cartridge 92F defines an outlet aperture 94F and an inlet aperture 96F. When the cartridge 92F is in a selected rotational position within the cavity 88F (as shown in FIG. 13), the cartridge outlet aperture 94F is in registry with the dispensing orifice 64F, and the cartridge inlet aperture 96F is in registry with a passage 91F which can communicate with a container flexible bag 14F through a non-return outlet valve body 83F.

The cartridge 92F contains a fluid product held in a fibrous material 93F. The fibrous material 93F can have substantially the same composition as the fibrous material 60 described above for the first embodiment illustrated in FIGS. 1–5 and 9.

The outer end of the cartridge 92F is preferably provided with a knob 98F. The knob 98F can be grasped by the user for rotating the cartridge 92F to align the apertures 94F and 96F as shown in FIG. 13 for dispensing a product spray. The cartridge 92F may also be rotated away from the rotational position illustrated in FIG. 13 so that flow through the dispensing orifice 64F is prevented.

If desired, additional (e.g., second, third, etc.) dispensing orifices (similar to orifice 64F) may be provided in the housing 20F across the front face of the housing so as to provide multiple product sprays. Such an alternate configuration would require that the cartridge 92F have additional outlet apertures (similar to the outlet aperture 94F) for registration with such additional dispensing orifices.

Figure 14:
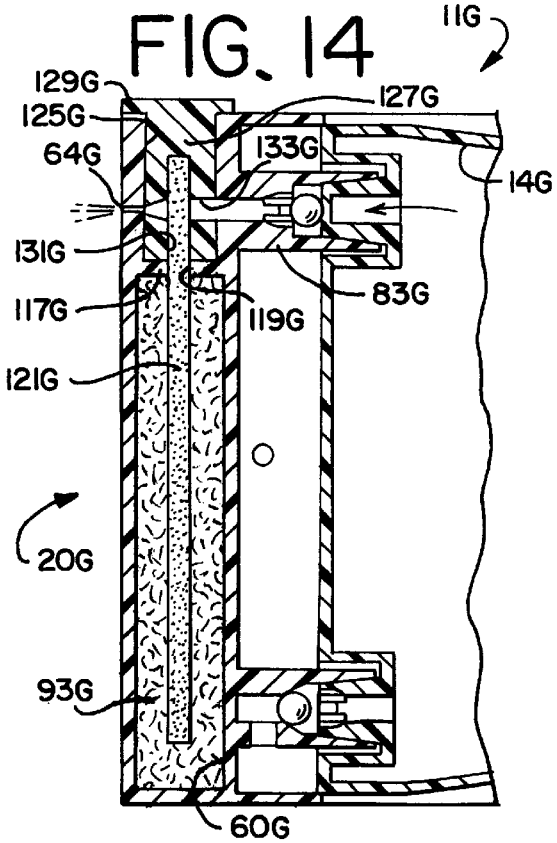
FIG. 14 is a view similar to FIG. 11, but FIG. 14 illustrates a eighth embodiment of the dispenser.

An eighth embodiment of the dispenser designated generally by the reference number 11G is illustrated in FIG. 14. The eighth embodiment of the dispenser 11G includes a container portion with inlet and outlet valves identical with the corresponding valves in the fifth embodiment of the dispenser 11D described above with respect to FIG. 11.

The dispenser 11G has a housing 20G which defines a product storage chamber 60G containing a fibrous material 93G. The fibrous material 93G can be identical with the fibrous material 60 described above with reference to the first embodiment of the dispenser 11D illustrated in FIGS. 1–5 and 9. Such material 93G holds a fluid product which is to be dispensed.

The housing 20G includes an intermediate cross wall 117G defining an aperture 119G. A wick 121G is disposed within the fibrous material 93G and extends through the aperture 119G into a bore 125G defined by the housing. A cylindrical valve plug 127G is rotatably mounted in the bore 125G and has an outer knob 129G which may be grasped for rotating the valve plug 127G within the bore 125G. The valve plug 127G defines an internal bore 131G for receiving the distal end of the wick 121G. The valve plug 127G also defines a passage 133G that is oriented perpendicular to the bore 131G and that intersects the bore 131G. When the valve plug 127G is in the selected rotational position as shown in FIG. 14, the valve passage 133G establishes communication between a dispensing orifice 64G defined in the housing 20G and an outlet valve 83G which is in communication with the interior of a flexible bag 14G. When the flexible bag 14G is compressed, the valve 83G opens to admit compressed air through the passage 133G around the extending portion of the wick 121G.

The wick 121G permits wicking of the fluid product from the fibrous fill material 93G into the passage 133G. The air flowing through the passage 133G mixes with the product carried on and in the wick 121G, and the mixture is expelled through the dispensing orifice 64G as a spray mixture.

Typically, the dispenser 11G would be initially provided to the user with the valve plug 127G rotated away from the open, registration position shown in FIG. 14. When the valve plug 127G is rotated away from the position shown in FIG. 14, the dispensing orifice 64G is blocked by the valve plug 127G. This seals the product within the dispenser 11G until the user is ready to operate the dispenser 11G. At that time, the user turns the knob 129G to rotate the valve plug 127G to the open position illustrated in FIG. 14.

The bore 125G in which the valve plug 127G is received may be characterized as defining a mixing chamber with the mixing being limited to only the portion of the mixing chamber which is defined within the valve plug passage 133G. It will be appreciated, however, that in an alternate embodiment (not illustrated), the valve plug 127G may be omitted. Instead, the housing 20G could be provided with a wall at the end of the mixing chamber or bore 125G so as to define a void space within the mixing chamber. In such an alternate embodiment, it would be desirable to prevent communication through the dispensing orifice 64G with the interior of the empty chamber or bore 125G prior to use. To that end, the dispensing orifice 64G could be initially occluded on the exterior of the housing 20G with a removable, adhesive tape tab (e.g., such as the tape tab 93D provided for the fifth embodiment of the dispenser 11D described above with reference to FIG. 11).

Figure 15:
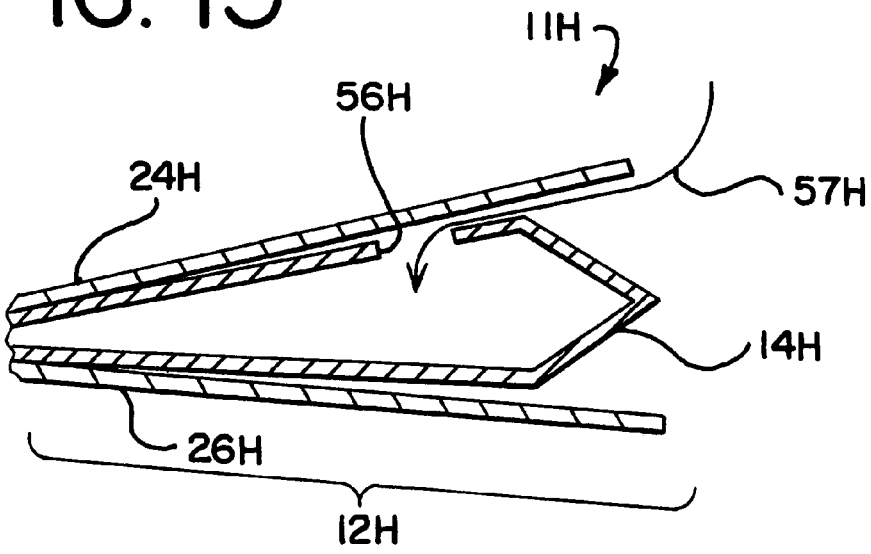
FIG. 15 is a fragmentary, cross-sectional view similar to FIG. 4, but FIG. 15 illustrates a ninth embodiment of the dispenser.
Figure 16:
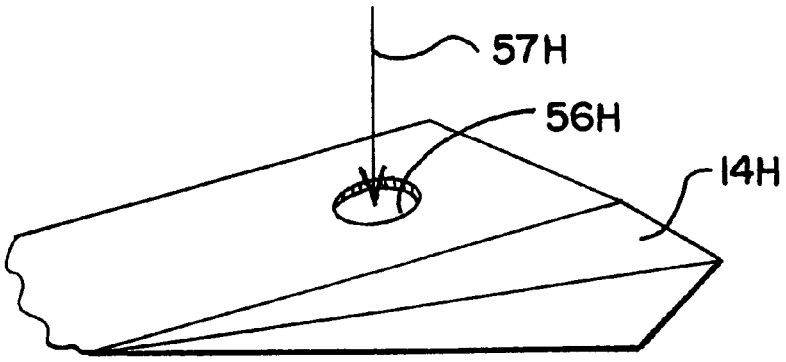
FIG. 16 is a fragmentary, perspective view of the ninth embodiment illustrated in FIG. 15, but the exterior plate-like members have been omitted for ease of illustration to show details of the inner bag.

FIG. 15 illustrates a ninth embodiment of the dispenser designated generally by the reference number 11H. The dispenser 11H incorporates a squeezable container 12H which includes a flexible bag, such as a rubber bag 14H. The container 12H also includes an upper plate-like member 24H and a lower plate-like member 26H.

The bag 14H is retained within the plates 24H and 26H by suitable means. However, the upper surface of a portion of the bag 14H below the upper plate-like member 24H is not sealed to the upper plate-like member 24H. In that unsealed region, the upper wall of the bag 14H defines an air inlet vent aperture 56H.

The front portion of the dispenser 11H (broken away on the left-hand side in FIG. 15) may include a product spray housing such as the housing 20 in the embodiment illustrated in FIGS. 1–5, except that the inlet vent apertures 56 and 54 in the housing 20 per se could be omitted. The bag 14H in the ninth embodiment could be retained within such a housing and/or secured to portions of the plate-like members 24H and 26H by suitable means, such as mechanical engagement structures, fasteners, adhesives, or the like.

When the plate-like members 24H and 26H are squeezed together, the aperture 56H in the top of the bag 14H is closed by the overlying plate-like member 24H, and a gas-tight seal is created owing to the increased internal pressure within the bag 14H which forces the upper wall of the bag 14H tight against the underside of the plate-like member 24H to occlude the aperture 56H. The air within the bag 14H is thus pressurized and caused to flow forward to mix with the product. To this end, the product may be mixed with the air and sprayed from the dispenser 11H in any suitable manner previously described with respect to any of the first eight embodiments or equivalent structures.

When the plate-like members 24H and 26H are released and permitted to return to the expanded condition (FIG. 15), the reduction in internal pressure within the bag 14H creates a pressure differential across the upper bag wall through the aperture 56H owing to the higher ambient air pressure on the exterior of the dispenser 11H. This forces the upper wall of the bag 14H to deflect inwardly away from upper plate-like member 24H. This opens the aperture 56H to permit the passage of air into the bag as shown by the flow arrow 57H.

It will be appreciated that the dispenser 11H can be characterized as including a squeezable container comprising at least the plate-like members 24H and 26H and the bag 14H. The vent aperture 56H is defined in the container, albeit in the bag part of the container. Further, it will be appreciated that the upper wall of the bag 14H around the aperture 56H, in conjunction with the upper plate-like member 24H, functions as a non-return inlet valve.

It will be appreciated that other modifications may be made to the above-described embodiments of the dispenser. For example, the container flexible bag (e.g., bag 14 in FIGS. 1–5) may be made by extrusion blowing of a rubber material. Alternatively, the bag may be fabricated from at least two cut pieces of polyethylene sheet which are juxtaposed in registry and heat-sealed together at their peripheral margins with the exception of portions of the peripheral margins defining an opening to the interior of the bag.

If the dispenser is to be used in an application that does not require a relatively thin or flat configuration, then the dispenser components can be fabricated with shapes different from those illustrated. Also, even in applications wherein it is desired to provide a relatively thin dispenser, the dispenser components could have shapes other than as shown in the figures.

It would also be appreciated that the various illustrated embodiments of the dispensers may be modified to include multiple dispensing orifices as well as multiple cavities containing fibrous material.

It will be readily apparent from the foregoing detailed description of the invention and from the illustrations thereof that numerous variations and modifications may be effected without departing from the true spirit and scope of the novel concepts or principles of this invention.

What is claimed is:

1. A pump spray dispenser comprising:

a squeezable container normally biased to an expanded condition, said container including a non-return inlet valve for admitting ambient atmospheric air as said container assumes said expanded condition and including a non-return outlet valve for discharging compressed air;

a housing defining (1) a dispensing orifice;

(2) a mixing chamber in communication with said dispensing orifice and said outlet valve;

(3) a product storage chamber containing a liquid product, (4) an aperture between said storage chamber and said mixing chamber; and a wick extending from said storage chamber through said aperture into said mixing chamber, said wick preventing bulk liquid flow of said product out of said storage chamber through said aperture but permitting wicking of said product along said wick from said storage chamber into said mixing chamber whereby said container can be squeezed to direct said compressed air through said outlet valve into said mixing chamber for mixing with said product and to dispense a spray mixture of said product and air from said orifice.

2. The dispenser in accordance with claim 1 in which said storage chamber contains polypropylene fiber fill material.

3. The dispenser in accordance with claim 1 in which said housing defines a bore;

said housing includes a cylindrical valve plug rotatably disposed in said housing bore;

said valve plug defines an internal bore for receiving the distal end of said wick;

said valve plug defines a passage which intersects said internal bore and which functions to define said mixing chamber in said housing; and said valve plug can be rotated to align said valve plug passage in registration with said dispensing orifice and said outlet valve.

4. The dispenser in accordance with claim 1 in which said dispenser further includes a removable, adhesive tab sealingly disposed on said housing over said orifice.

* * * * *